US006701832B1

(12) United States Patent
Hawkins

(10) Patent No.: US 6,701,832 B1
(45) Date of Patent: Mar. 9, 2004

(54) TOP LOADING, AUTOMATICALLY COMPACTING TRASH CAN FOR HIGH-TRAFFIC PUBLIC VENUES

(75) Inventor: Bobby L. Hawkins, Travelers Rest, SC (US)

(73) Assignee: AMPRO, Travelers Rest, SC (US)

( * ) Notice: Subject to any disclaimer, the term of this patent is extended or adjusted under 35 U.S.C. 154(b) by 0 days.

(21) Appl. No.: 10/012,373

(22) Filed: Oct. 30, 2001

(51) Int. Cl.[7] ..... B30B 15/16; B30B 15/30

(52) U.S. Cl. ..... 100/49; 100/215; 100/229 A; 100/233

(58) Field of Search ..... 100/48, 229 A, 100/902, 49, 99, 52, 215, 233, 295

(56) References Cited

U.S. PATENT DOCUMENTS

| | | | | |
|---|---|---|---|---|
| 3,901,139 A | * | 8/1975 | Moriconi | 100/215 |
| 4,147,100 A | | 4/1979 | Dykstra | |
| 4,432,278 A | * | 2/1984 | Skipworth | 100/131 |
| 4,552,061 A | | 11/1985 | Brutsman | |
| 4,559,870 A | | 12/1985 | Krummacher et al. | |
| 4,638,730 A | | 1/1987 | Bonacorsi | |
| 4,870,898 A | | 10/1989 | Spencer | |
| 4,896,593 A | | 1/1990 | Slusser | |
| RE33,527 E | | 1/1991 | Fox | |
| 4,991,500 A | | 2/1991 | Knapp | |
| 5,001,977 A | | 3/1991 | Tracy | |
| 5,012,732 A | | 5/1991 | Fox | |
| 5,025,719 A | | 6/1991 | Thomas | |
| 5,042,374 A | | 8/1991 | Klepacki | |
| 5,263,412 A | | 11/1993 | Chenard et al. | |
| 5,307,607 A | | 5/1994 | Tondo | |
| 5,465,660 A | | 11/1995 | Conti et al. | |
| 5,517,907 A | | 5/1996 | Fox | |
| 5,619,915 A | | 4/1997 | Wagner et al. | |
| 5,690,025 A | | 11/1997 | Hawkins | |
| 5,752,439 A | | 5/1998 | LaMora, Jr. | |
| 5,816,145 A | | 10/1998 | Lackner | |
| 5,845,567 A | | 12/1998 | Fischer | |
| 5,884,556 A | | 3/1999 | Klepacki et al. | |
| 6,158,692 A | * | 12/2000 | Abild et al. | 244/129.5 |

* cited by examiner

*Primary Examiner*—Allen Ostrager
*Assistant Examiner*—Jimmy T Nguyen
(74) *Attorney, Agent, or Firm*—Dority & Manning, P.A.

(57) ABSTRACT

The present invention contemplates a trash can that one finds in high-traffic public venues. The trash can receives trash through an opening in the top of the housing. A trash by-pass chute is disposed within the housing and transports the trash from the opening in the top to the lower portion of the housing. A mechanism for automatically compacting the trash in the lower portion of the housing is provided within the housing. The compacted trash may be removed from the lower portion of the housing via a door that opens to allow access through the side of the trash can. The mechanism for compacting trash contents includes a frame disposed within the housing, and a compacting mechanism carried by the frame. The compacting mechanism includes a platen and is configured for moving the platen through a compaction stroke to apply compacting pressure to trash contents located in the lower portion of the housing during at least a portion of a compaction stroke. The pivotable portion of the platen pivots to by-pass the trash by-pass chute during at least a portion of a retraction stroke of the compacting mechanism.

25 Claims, 11 Drawing Sheets

TOP LOADING, AUTOMATICALLY COMPACTING TRASH CAN FOR HIGH-TRAFFIC PUBLIC VENUES

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

Trash compactors sized for consumer use include a trash receptacle open at the top and disposed beneath a platen that can be lowered into the trash receptacle to compress the trash. U.S. Pat. No. 5,690,025, which is hereby incorporated herein by this reference, discloses a typically compactor that includes a housing with a trash opening 20 that is disposed through the side of the housing. The trash opening 20 is disposed at a height that is higher than the opening of the trash receptacle and lower than the retracted height of the platen. In this way, trash entering the compactor enters in a space disposed between the retracted height of the platen and the open top of the trash receptacle.

In some compactor embodiments such as disclosed in U.S. Pat. No. 4,870,898 to Spencer and U.S. Pat. No. 5,517,907 to Fox, which are hereby incorporated herein by this reference, the platen includes a portion that pivots with its free edge upwardly away from the opening of the trash receptacle and above the height of the trash opening 20 in the sidewall 18 of the housing.

Trash cans located on the premises of public venues such as airport terminals for example, include a housing that surrounds a trash receptacle. The housing typically includes a removable top that has an opening disposed above the opening of the trash receptacle. In some embodiments, the opening in the top of the housing can be provided with a spring-loaded closure that biases the closure in a position that seals and closes the opening in the top. When these trash cans become full, an attendant must remove the top of the housing and empty the contents into a larger bin for transport to a collection site from which the trash is removed from the premises to a disposal facility. The type of trash that the public disposes in the trash can typically occupied a relatively large volume and low density, as it consists largely of items such as beverage cans, cups composed of plastic or styrofoam, papers, and the like. Because this type of trash occupies a relatively large volume for its weight, attendants must frequently empty the trash receptacle to prevent the trash from overflowing the receptacle and clogging the opening in the top of the housing of the trash can. Because of the volume of trash in each trash can, a single attendant cannot empty very many trash cans in a single circuit of the attendant's assigned area. This disability limits the number of trash cans that can be monitored by any one attendant during the time span in which each can is expected to become full.

OBJECTS AND SUMMARY OF THE INVENTION

It is a principal object of the present invention to provide a trash can for high traffic public areas.

It is a further principal object of the present invention to provide a trash can with an opening through the top and means for periodically and automatically compacting the trash.

It is another principal object of the present invention to provide a trash can for high traffic public areas with an opening through the top of the trash can and means for periodically and automatically compacting the trash.

It is yet another principal object of the present invention to provide a top loading trash can with a compacting mechanism that includes a platen having a portion that is pivotable out of the way of the path of trash entering the housing from the top and falling into the opening of the trash receptacle.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a trash can that one finds in high-traffic public venues can includes a housing with an opening in the top of the housing. A trash by-pass chute is disposed within the housing and transports the trash from the opening in the top to the lower portion of the housing. A mechanism for automatically compacting the trash in the lower portion of the housing is provided within the housing. The compacted trash may be removed from the lower portion of the housing via a door that opens to allow access through the side of the trash can. The mechanism for compacting trash contents can be carried by a frame disposed within the housing. The compacting mechanism can include a platen and can be configured for moving the platen through a compaction stroke to apply compacting pressure to trash contents located in the lower portion of the housing during at least a portion of a compaction stroke. The platen can include a pivotable portion that pivots to by-pass the trash by-pass chute during at least a portion of a retraction stroke of the compacting mechanism. The compacting mechanism desirably includes and is controlled by a programmable controller. A hatch can be provided to selectively block the entrance of the trash by-pass chute under the control of the controller. A hatch stop can be provided to selectively prevent the hatch from moving to allow trash to enter the trash by-pass chute. The controller can be connected to control operation of the hatch stop. A detector can be disposed to detect when trash enters the trash by-pass chute and to report this information to the controller. The controller can be programmed to activate the trash compacting mechanism to compact the trash in the lower portion of the housing after the detector registers a predetermined number of times when trash enters the trash by-pass chute. A sensor can be provided and disposed to detect when the door is closed and locked and report this information to the controller, which can be programmed to prevent the trash compacting mechanism from operating unless the door is closed and locked. The controller can be programmed to activate the hatch stop to prevent the hatch from allowing trash to enter the trash by-pass chute during the operation of the trash compacting mechanism to compact the trash in the lower portion of the housing.

The accompanying drawings, which are incorporated in and constitute a part of this specification, illustrate a presently preferred embodiment of the invention as well as some alternative embodiments. These drawings, together with the description, serve to explain the principles of the invention but by no means are intended to be exhaustive of all of the possible manifestations of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description. While components of the invention are described below as desirably functioning in a particular way or as desirably formed or structured in a particular way, this is not intended to eliminate from the scope of the invention, alternative functioning, forming or structuring.

The present invention contemplates a trash can that looks for all the world like the type of trash cans that one finds in high-traffic public venues such as train stations, airports, department stores, shopping malls, food courts and the like. However, although the trash can receives trash through an opening in the top, the trash can contains a mechanism for automatically compacting the trash. In accordance with the present invention, an apparatus for containing and compacting trash contents includes a housing, a frame disposed within the housing, a trash by-pass chute 36 disposed within the housing and a compacting mechanism carried by the frame. The compacted trash may be removed from the lower portion 16 of the housing via a door that opens to allow access through the side of the trash can.

Figure 1:
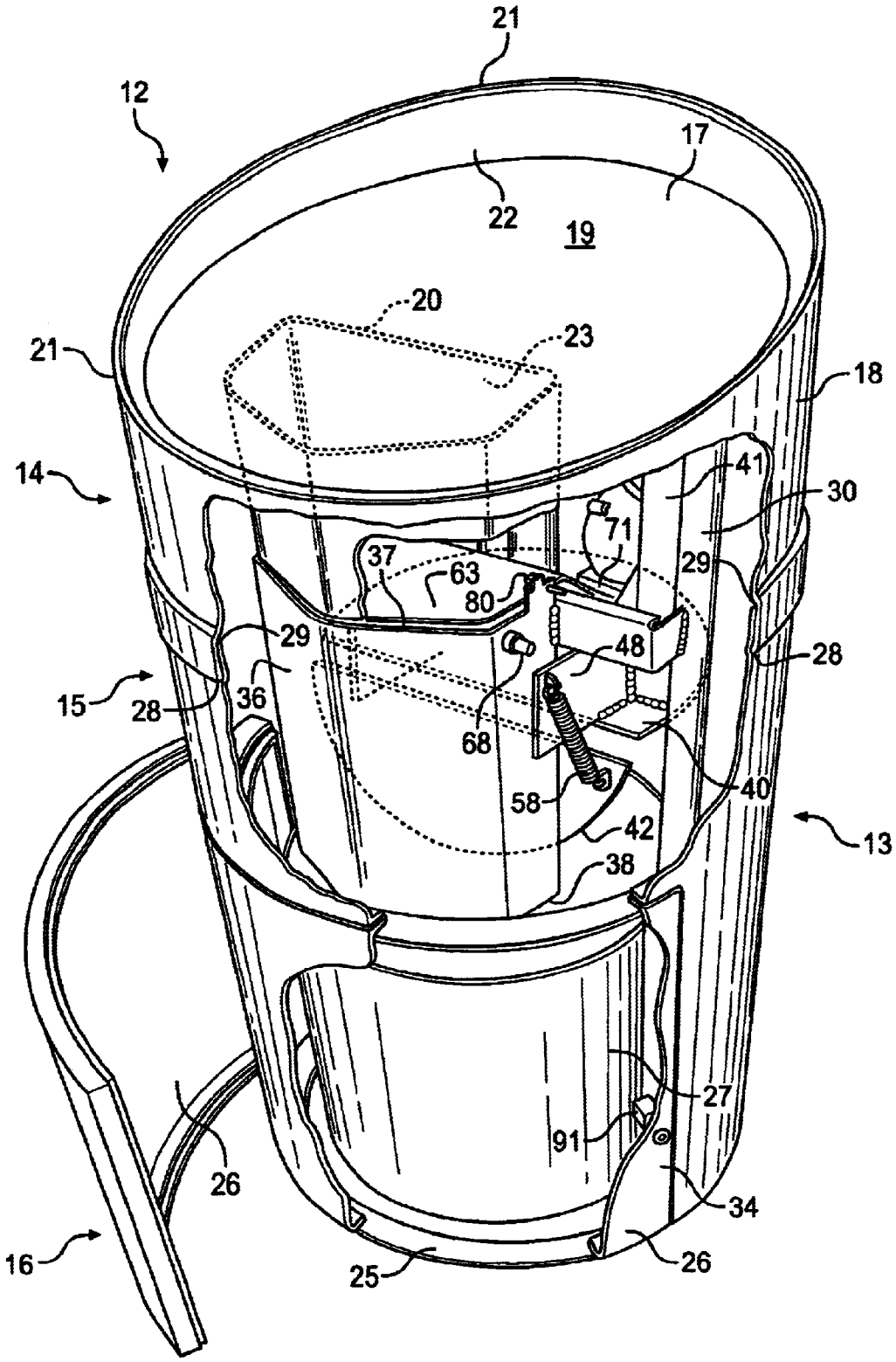
FIG. 1 is an elevated perspective view with sections cut away and elements shown in phantom (dashed line) of a presently preferred embodiment of the top loading, automatically self-compacting trash can for high-traffic public venues in accordance with the present invention.
Figure 3A:
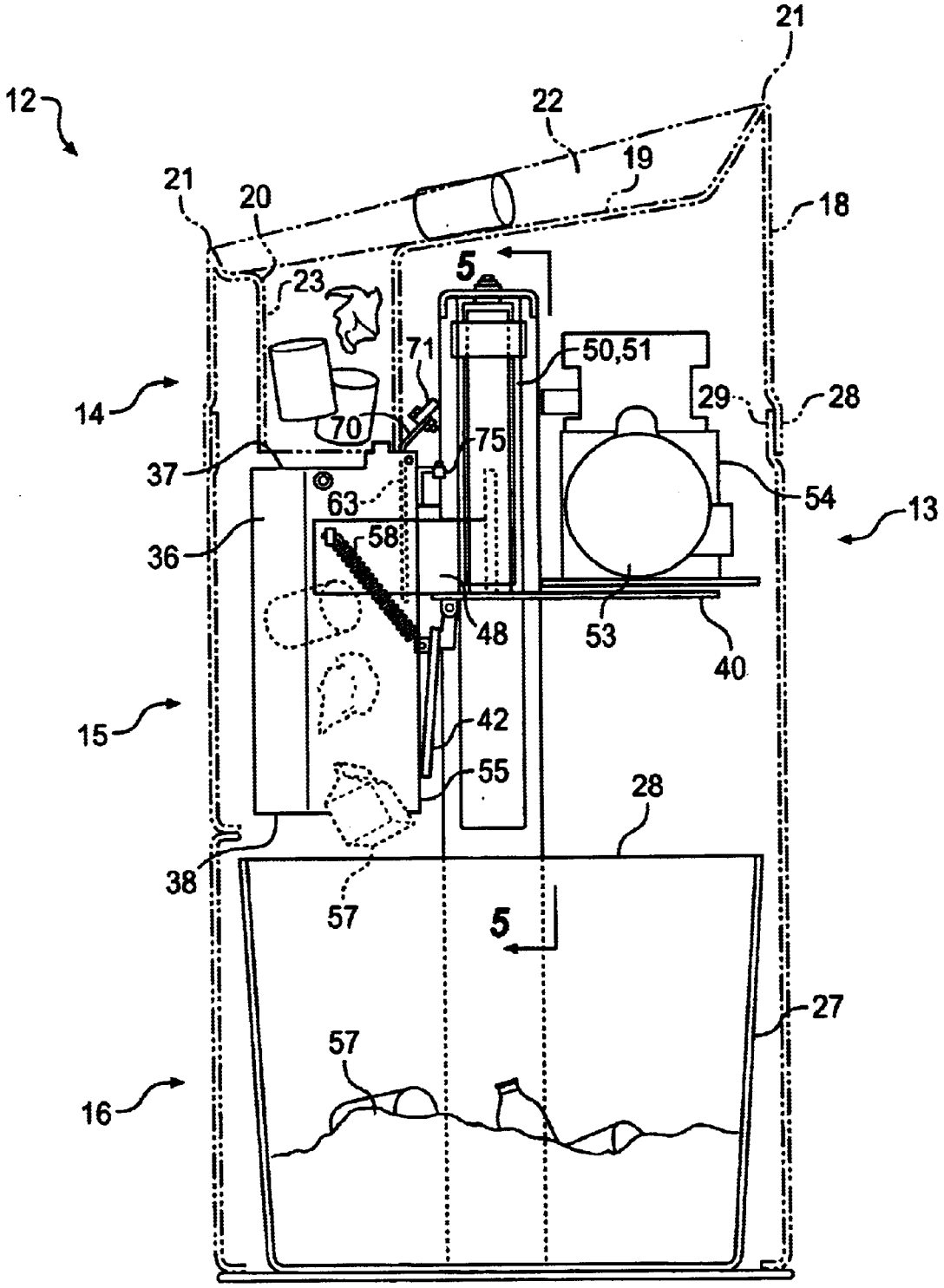
FIG. 3A is side plan view of the embodiment of FIG. 1 with elements shown in phantom (chain-dashed line)
Figure 3B:
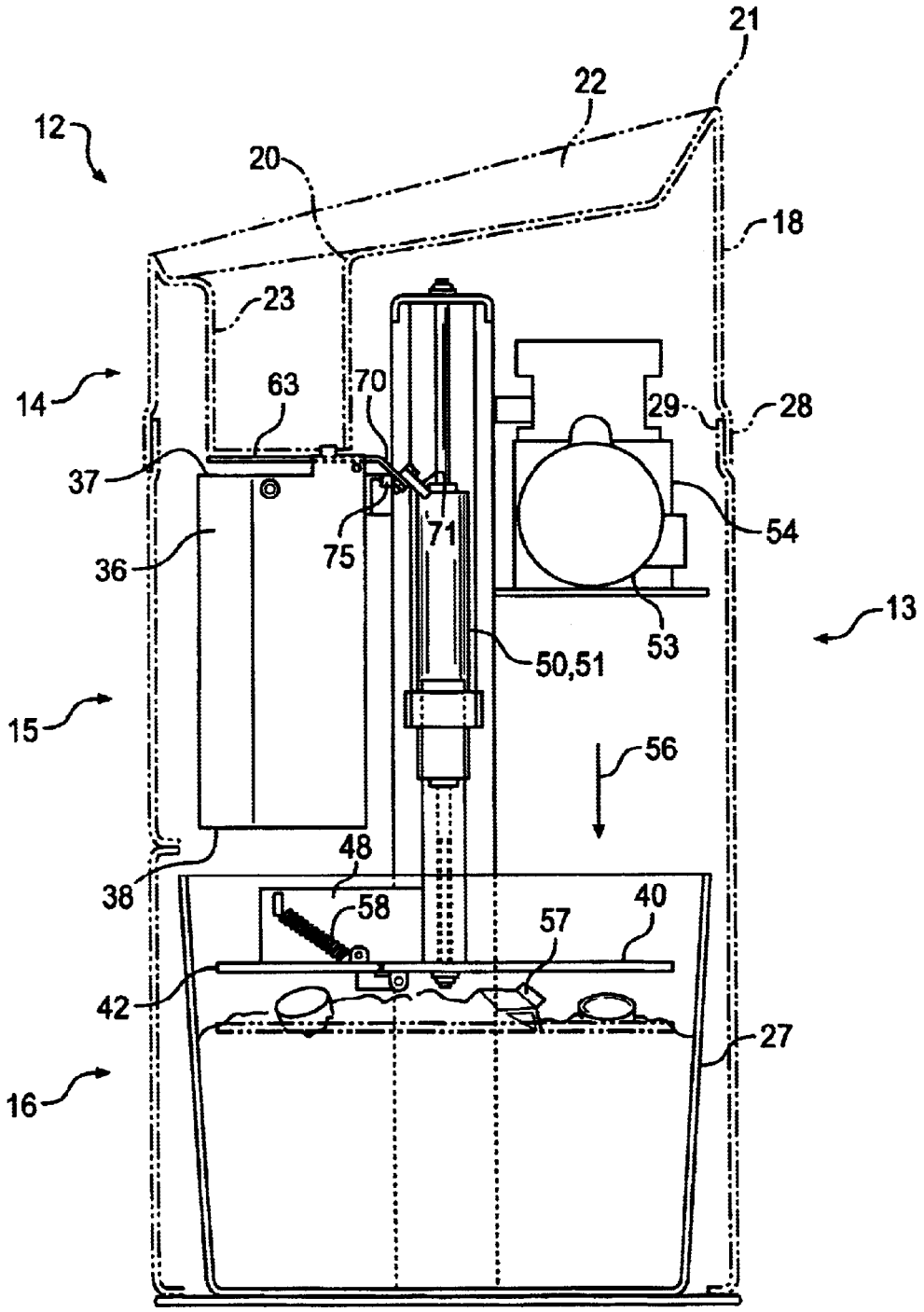
FIG. 3B is side plan view of the embodiment of FIG. 1 with elements shown in phantom (chain-dashed line)

A presently preferred embodiment of the inventive trash can is generally designated in FIG. 1 by the numeral 12. Trash can 12 includes an outer shell that forms a housing that is generally designated by the numeral 13. As shown in FIGS. 1, 3A and 3B for example, the housing 13 includes an upper portion 14 14, a lower portion 16 and an intermediate portion 15 disposed between the upper portion 14 and the lower portion 16. As shown in FIGS. 1, 3A and 3B for example, the upper portion 14 is desirably selectively detachable and attachable to the intermediate portion 15. This can be effected by a frictional interfit whereby the leading edge 29 of the intermediate portion is received telescopically within the leading edge 28 of the upper portion 14. The opposite arrangement (upper portion 14 received within intermediate portion 15) is also possible, but is less desirable from both an aesthetic and functional standpoint. The ability of the upper portion 14 to detach from the intermediate portion 15 facilitates servicing of the trash can. However, in some embodiments, the upper portion 14 of the housing can be formed as part of a unitary structure with the intermediate portion 15 of the housing.

The overall shape of the housing 12 can be formed in any manner that is deemed aesthetically desirable. In the presently preferred embodiment shown in FIG. 1, the housing 12 takes a circular cylindrical shape. The cylindrical shape minimizes the surface area of the housing for any given volume. However, the transverse cross section of the housing 12 could take on the shape of a square or other polygon or a combination of arcuate and flat surfaces and lines.

As shown in FIG. 1 for example, the housing 13 includes a top 17 and a sidewall 18 connected to the top. The top extends generally transversely relative to the axial vertical direction in which the sidewall 18 of the housing 13 extends. The top 17 and an upper section of the sidewall 18 form the upper portion 14 of the housing 13. The top 17 of the housing includes a top wall 19 may be recessed from the upper edge 21 of the top 17 of the housing 13. Thus, the top 17 can include a peripheral lip 22 that is raised vertically above the level of the top wall 19.

As shown in FIGS. 1, 3A and 3B for example, a trash opening 20 is defined through a portion of the top wall 19 of the upper portion 14 of the housing 13. The shape of the trash opening 20 can be any shape that is desired. In the embodiment shown, the shape of the trash opening 20 is five-sided with two sides joining to form an obtuse angle having an apex pointing in a generally radial direction from the center of the top 17 to the circular periphery of the top 17.

As shown in FIGS. 1, 3A and 3B (chain dashed line in FIGS. 3A and 3B) for example, the top wall 19 of the housing can be gently sloped toward the trash opening 20. With the top wall 19 so inclined, trash placed on the top wall 19 of the housing 13 tends to feed toward the trash opening 20 under the influence of the force of gravity. Aligned with the trash opening 20, an axially extending funnel member 23 can be provided. The funnel 23 functions to guide the trash entering the trash opening 20. The funnel 23 guides the trash through the vertical drop that occurs within the upper portion 14 of the housing. A first end of the funnel 23 can be connected to and contiguous with the trash opening 20 in the top 17 of the housing 13. The upper portion 14 of the housing 13, which includes the top wall 19 of the housing, and the funnel 23 desirably can be formed as a unitary structure. However, in an alternative embodiment, different pieces can be joined to form the sidewall 18 of the housing, the top wall 19 and the funnel 23. The top wall 19, the funnel 23 and the sidewall 18 of the upper portion 14 of the housing 13 desirably can be formed from stamped metal or molded plastic, as desired.

As shown in FIG. 1 for example, an access opening 25 is defined through the lower portion 16 of the housing 13. The lower portion 16 of the housing also is partly composed of a door 26 that is configured to selectively open and close the access opening 25. The door 26 is shown in FIG. 1 in solid line in its closed orientation and in chain dashed line in its open orientation. The door 26 can be hinged at one side as shown in FIG. 1. Alternatively, the door 26 can be a sliding door. With a housing that is shaped differently than the cylindrical shape shown in FIG. 1, other mechanisms for attaching the door 26 may lend themselves to take advantage of the alternative configurations of the shape of the housing. For example, where the transverse cross-sectional shape of the housing is in the form of the polygon, one of the facets of the polygon may define the door, which may be hinged at the top or the bottom if desired.

Figure 10:
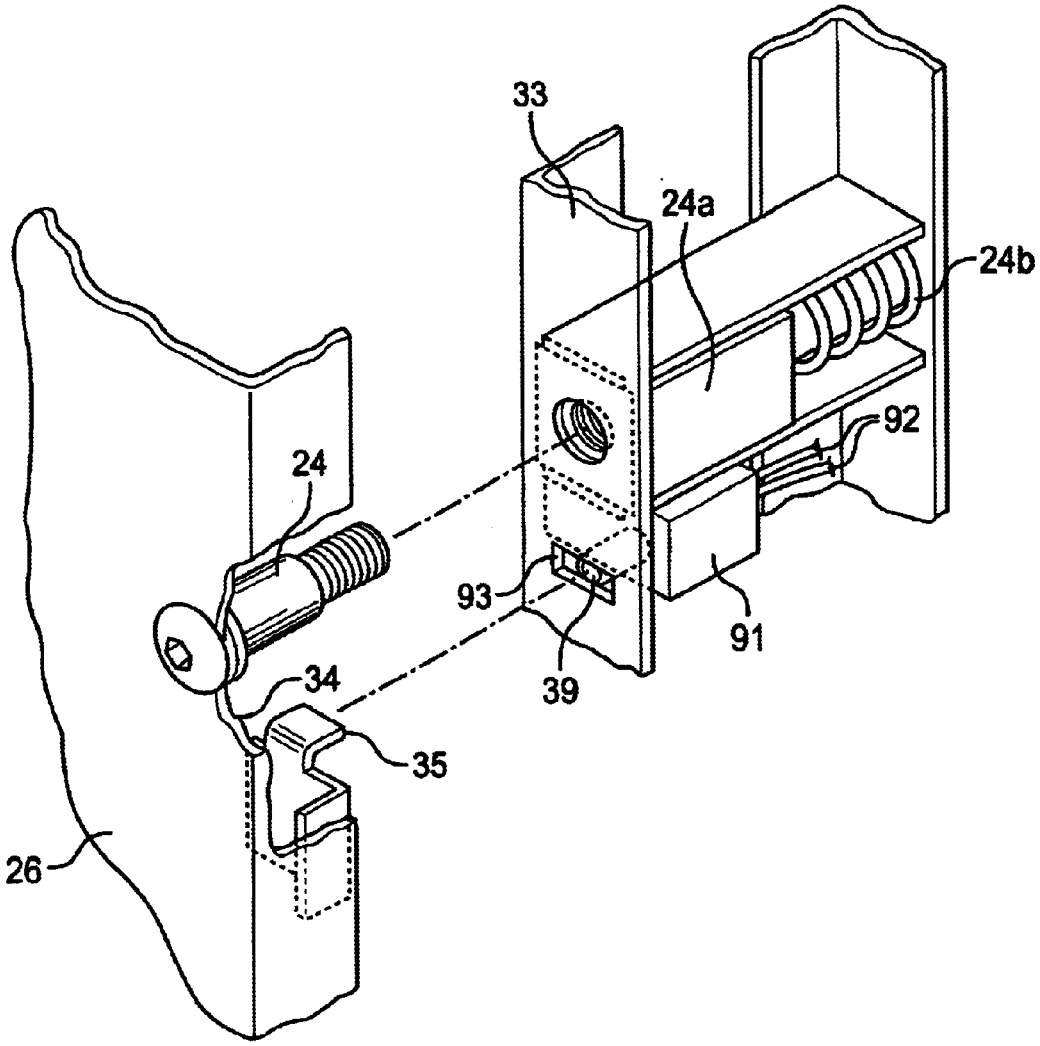
FIG. 10 is an elevated perspective view of components of a portion of the embodiment of FIG. 1.

A locking mechanism is provided for the door 26 to selectively secure the door 26 to the frame. As embodied herein and shown in FIGS. 1 and 10 for example, an edge 34 of the door 26 receives a bolt 24 that is threaded on a free end and has a head on the opposite end that is configured with a hexagonal-shaped opening to receive therein an Allen wrench for example. A nut 24*a* is mounted in a section 33 of the frame that is disposed to butt against the edge 34 of door 26 and is provided with a threaded opening that mates with the threaded end of bolt 24. As shown in FIG. 10 for example, nut 24*a* can be biased with a spring 24*b* that pushes nut 24*a* in a direction that opposes the force applied to nut 24*a* during insertion of the threaded end of bolt 24 into the threaded opening of nut 24*a*. Other locking mechanisms can be provided for the door 26 so long as they somewhat limit access to the access opening 25 such as by requiring a special key to be opened such as a tool like an Allen wrench.

As shown in FIGS. 1, 3A and 3B for example, in a presently preferred embodiment, a trash receptacle 27 can be disposed selectively in the lower portion 16 of the housing. The trash receptacle 27 can be in the form of a tub, a vat or a pail for example. As shown in FIGS. 1, 3A and 3B for example, the upper peripheral edge 28 of the trash receptacle 27 defines an open top. Thus, the upper peripheral edge 28 of the trash receptacle 27 can define a receptacle opening that is disposed to receive trash contents that are deposited through the trash opening 20 in the top 17 of the housing 13. However, the trash receptacle 27 is not an essential component of every embodiment of the present invention.

As explained below, the trash that is collected in the trash receptacle 27 can be compressed within the trash receptacle 27, which then can be selectively removed from the lower portion 16 of the housing via the access opening 25. An empty trash receptacle 27 also can be selectively inserted into the lower portion 16 of the housing in the same manner, using the door 26 that is defined as part of the lower portion 16 of the housing 13.

In an alternative embodiment, the rigid tub or vat that defines the trash receptacle 27 shown in FIG. 1 for example, can be replaced by a trash bag (not shown) that is formed of plastic for example. The upper edge of the opening in the trash bag can be hung around the interior of the lower portion 16 of the housing 13. Once the trash is compacted in the trash bag, the upper edge of the trash bag can be unhung from within the housing 13 and gathered at the top to close the opening in the trash bag. The attendant then can remove the trash bag from the trash can 12 and cart the bag off to a central collection point for the trash.

Figure 2:
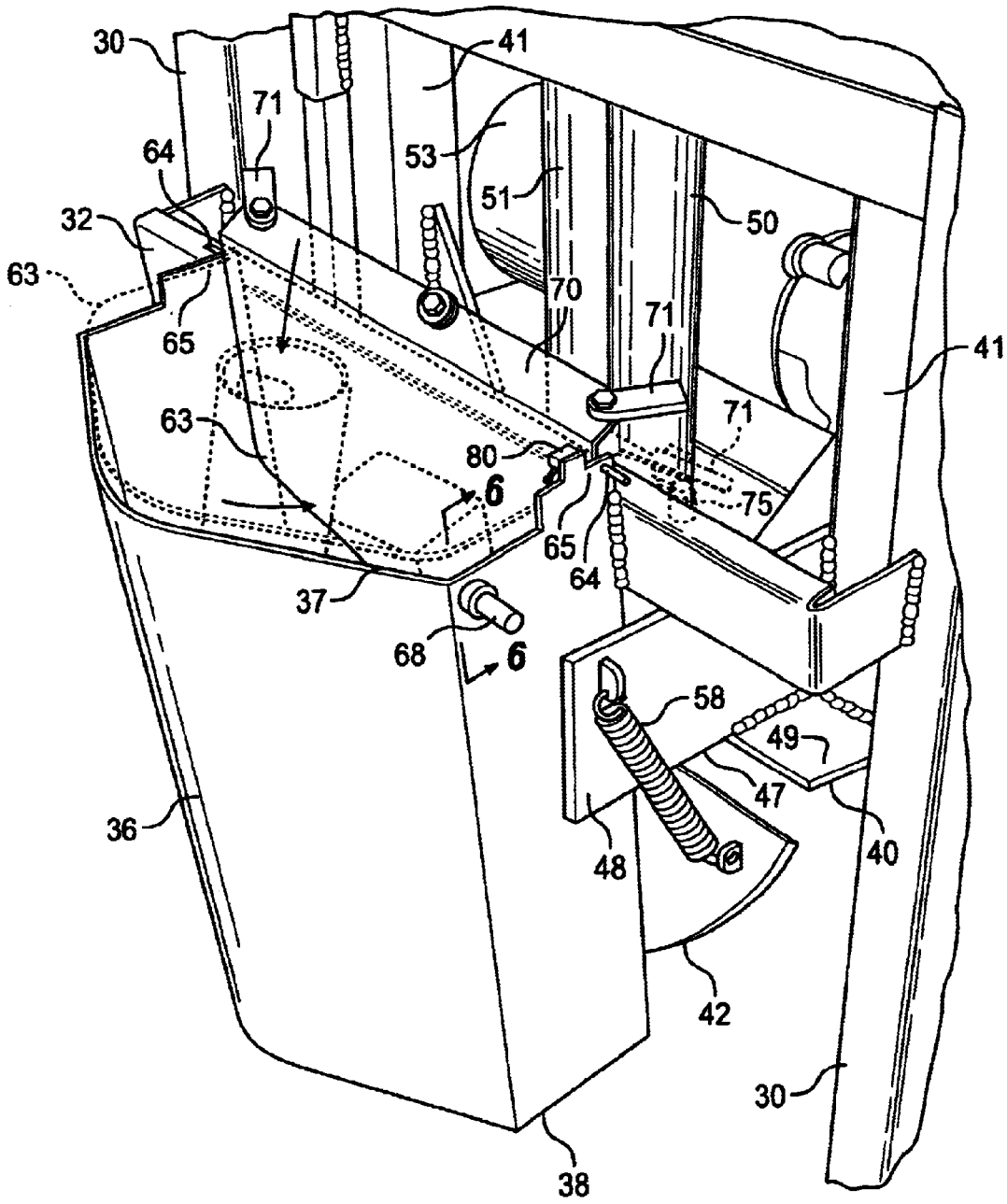
FIG. 2 is an elevated perspective view of components of the embodiment shown in FIG. 1 with elements shown in phantom (chain-dashed line)
Figure 5:
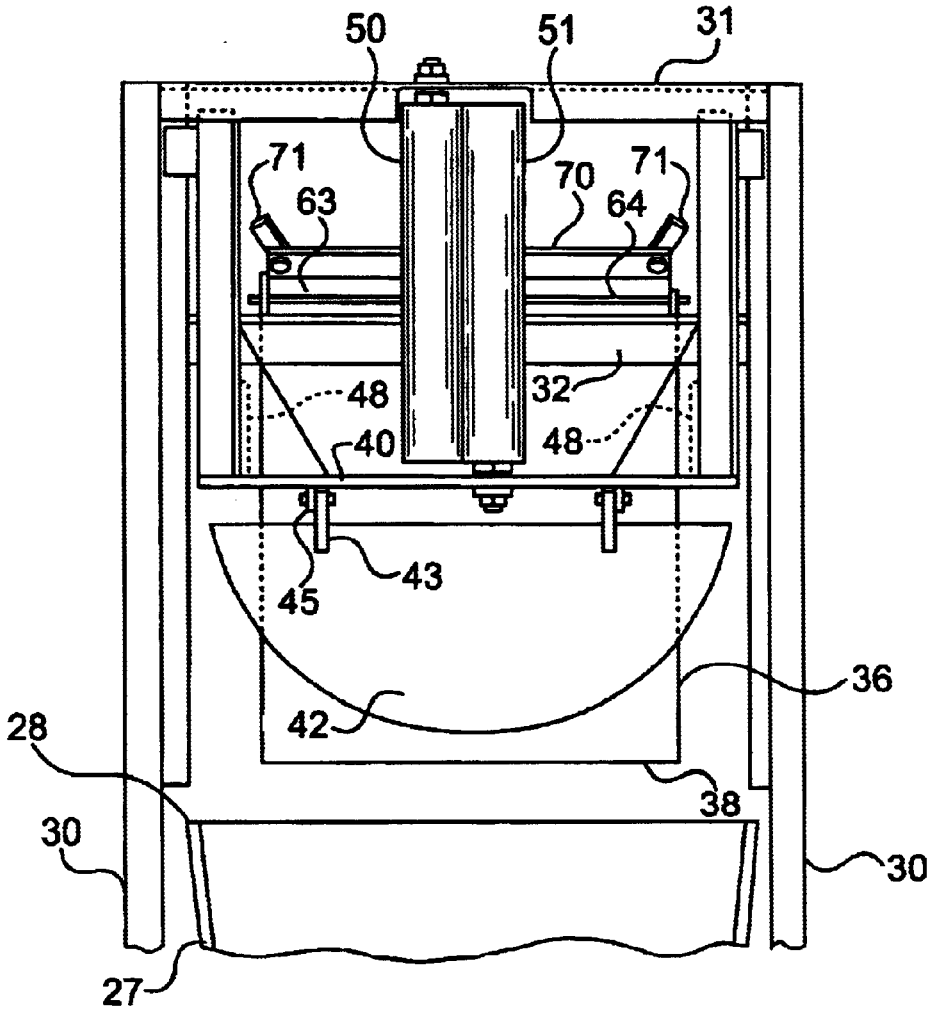
FIG. 5 is a rear plan view of components of the embodiment of FIG. 1 with portions removed to reveal the platen oriented in the position shown in the view taken along the direction of the arrows 5—5 in FIG. 3A.

The apparatus for containing and compacting trash contents also includes a frame that is disposed within the housing. As shown in FIGS. 2 and 5 for example, the frame includes a plurality of rigid structural members that carry and/or provide support for other components of the trash can of the present invention. These components of the frame typically include a pair of spaced apart vertically extending side rails 30 and a top rail 31 having opposite ends. One end of the top rail 31 can be desirably connected to the top of each side rail 30. The frame also can include a cross brace 32 that has opposite ends connected to the front of the side rails 30 at an intermediate location along their lengths and extends transversely with respect to the side rails 30.

As embodied herein and shown in FIG. 2 for example, the frame can be formed as an integrated structure composed of a number of permanently attached sub-components, as by welding or riveting for example. Alternatively, some or all of the sub-components can be attached to one another in a way that renders them detachable, as by nuts and bolts for example. Moreover, the frame can be formed as two or more unattached sub-assemblies of sub-components so that none of the sub-assemblies is connected to any of the other sub-assemblies in the frame. The frame desirably is connected to the housing 13, but can remain detached in alternative embodiments.

In accordance with the present invention, a trash by-pass chute is disposed within the housing. As embodied herein and shown in FIGS. 1, 3A and 2B for example, the by-pass chute 36 desirably has an entrance 37 that is aligned generally with the trash opening 20 in the top 17 of the housing 13. The by-pass chute 36 also has an exit 38 that is disposed to empty into the lower portion 16 of the housing 13. As embodied herein and shown in FIG. 2 for example, at least the entrance 37 of the by-pass chute 36 desirably has a transverse cross-sectional shape that conforms generally to the shape of the trash opening 20 defined in the top wall 19 of the housing 13. In the illustrated embodiment, the shape of the trash opening 20 and the shape of the entrance 37 of the by-pass chute 36 is also imposed desirably on the funnel 23 that feeds into the entrance 37 of the by-pass chute 36. In the embodiment shown in FIG. 2 for example, at least a portion of the trash by-pass chute 36 is carried by the frame within the housing 13 and is permanently attached to a portion of the frame, as by welding to the cross brace 32.

As shown in FIG. 1 for example, the by-pass chute 36 is disposed generally in the intermediate portion 15 of the housing and provides a vertically aligned hollow structure. The entrance 37 of the by-pass chute 36 is aligned generally with the trash opening 20. It also coincides generally with a second end of the funnel 23 (if the embodiment includes a funnel 23) that is opposite the funnel's first end, which is connected to the trash opening 20. As shown in FIGS. 3A and 3B for example, the trash by-pass chute 36 has an exit 38 that is disposed to empty into the lower portion 16 of the housing. In the embodiment shown in FIGS. 1, 3A and 3B, the exit 38 of the by-pass chute 36 empties directly into the trash receptacle 27 through the open top of the trash receptacle 27. As will become more apparent after description of the compacting mechanism (described below), the by-pass chute 36 functions to provide a directed conduit for the trash from the upper portion 14 of the housing 13 through the intermediate portion 15 of the housing. As will be explained below, components of the compacting mechanism must move into the lower portion 16 of the housing where the trash is to be compacted by the compacting mechanism. And this must be accomplished without components of the compacting mechanism becoming contaminated by trash that must travel from the top 17 of the housing 13 all the way down to the housing's lower portion 16 where the compacting will occur.

In further accordance with the present invention, a compacting mechanism is provided. The compacting mechanism is desirably carried by the frame and includes a platen. The compacting mechanism is configured for moving the platen through a compaction stroke in order to apply compacting pressure to the trash contents that are disposed in the lower portion 16 of the housing. This compacting pressure is applied to the trash during at least a portion of the compaction stroke. In delivering the compaction stroke, at least some components of the compacting mechanism move from the intermediate portion 15 of the housing 13 into the lower portion 16 of the housing and then return through the intermediate portion 15 of the housing.

As embodied herein and shown in FIGS. 1, 2, 3A and 3B for example, the compacting mechanism desirably includes a sturdy, rigid flat plate that forms a first portion 40 of the platen. As embodied herein and shown in FIG. 2, the compacting mechanism also includes an extendable member, which can include a carriage that comprises a pair of opposed side bars 41. Each side bar 41 slideably engages one of the side rails 30 forming the frame. As shown in FIG. 2, the first portion 40 of the platen desirably is connected to and carried by the lower ends of the side bars 41 that form the carriage. Each side bar 41 desirably rides within one of the opposed tracks formed in one of the side rails 30 of the frame. As shown in FIGS. 2, 4A, 4B, and 4C, for example, one of the opposed ends of each side bar 41 is rigidly connected to a first portion 40 of the platen as by welding.

Figure 4A:
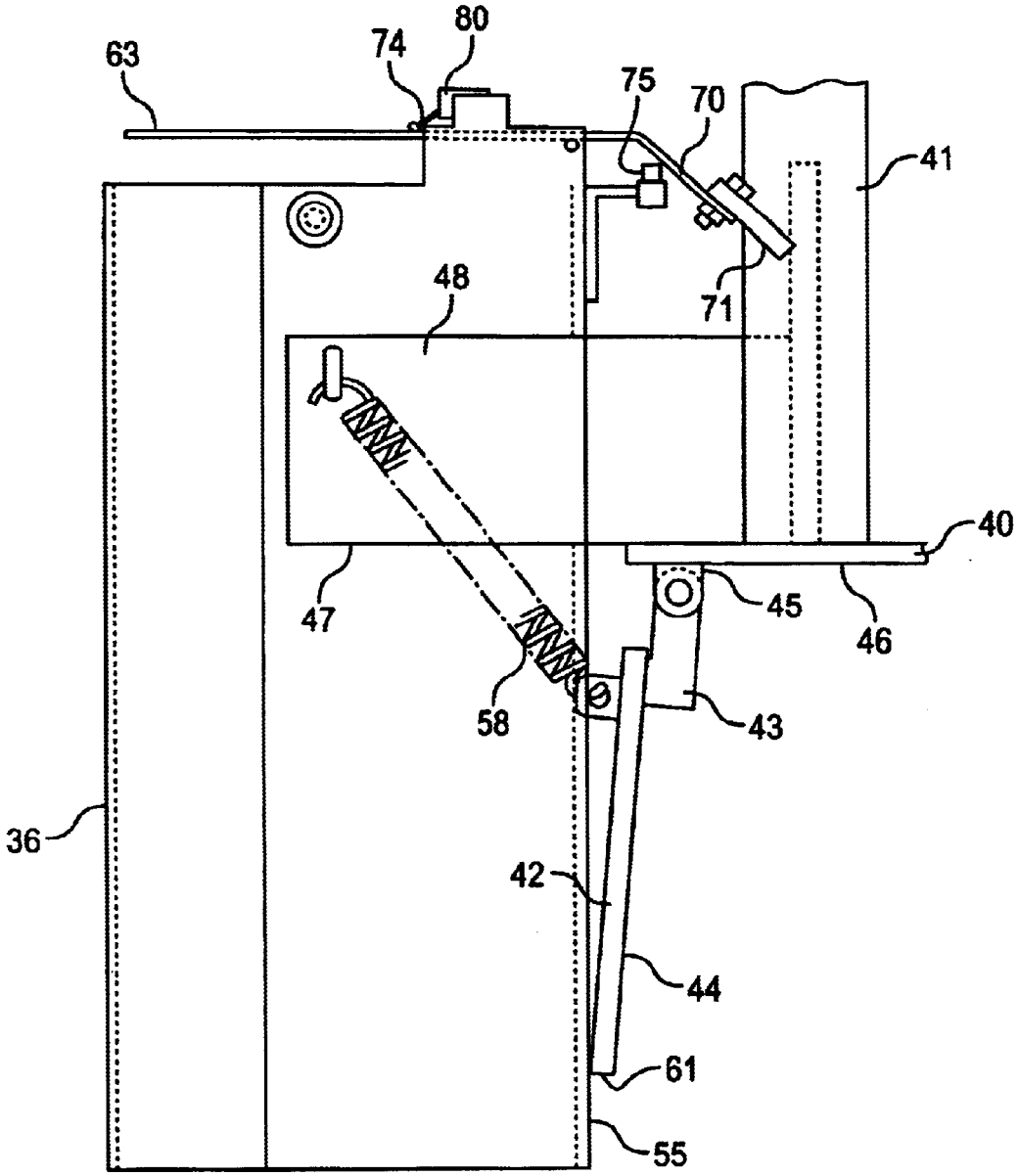
FIG. 4A is a side plan view of portions of components of the embodiment of FIG. 1 with the platen in the retracted position.
Figure 4B:
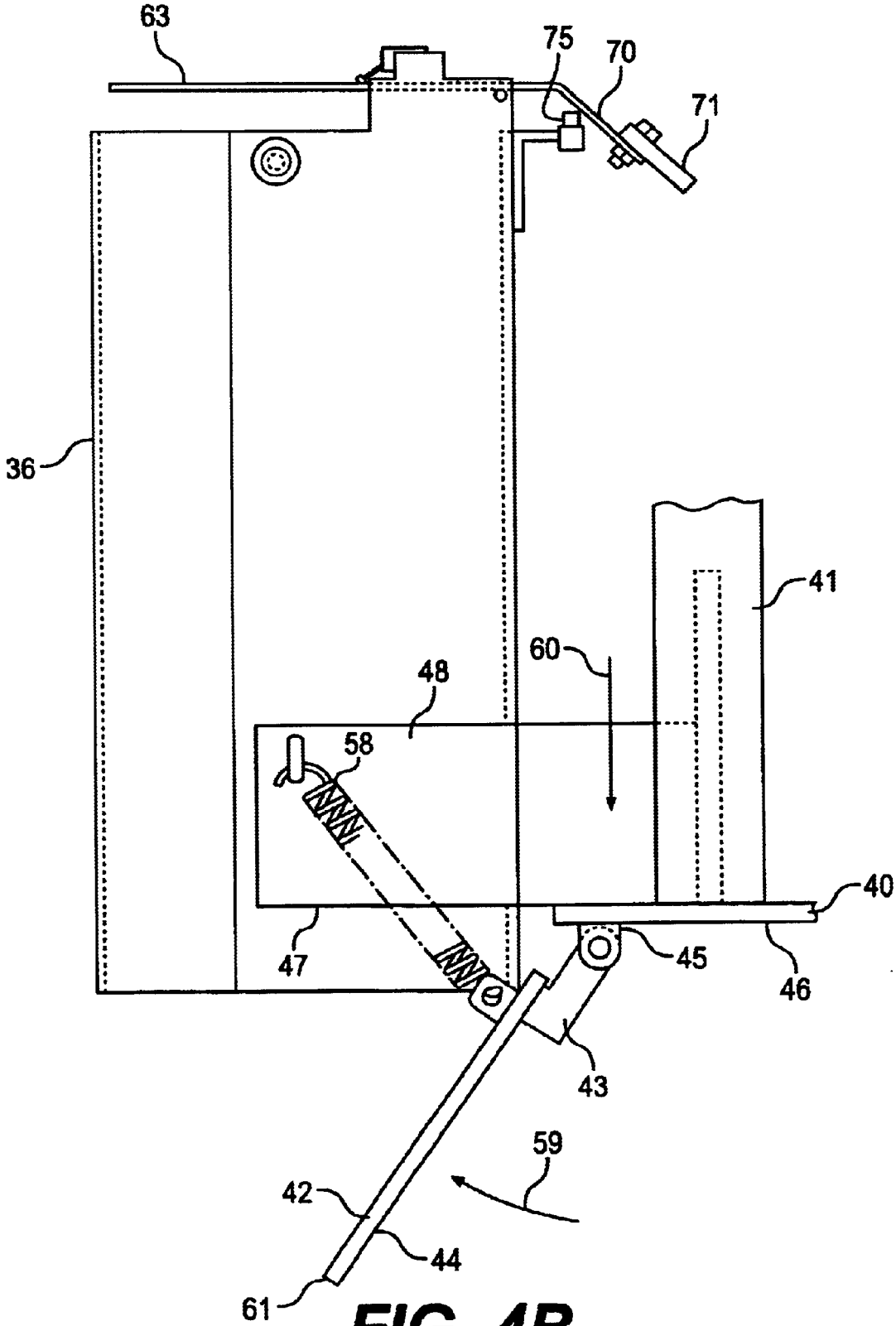
FIG. 4B is a side plan view of components of the embodiment of FIG. 1 with the platen in the position moving toward the position for compaction.
Figure 4C:
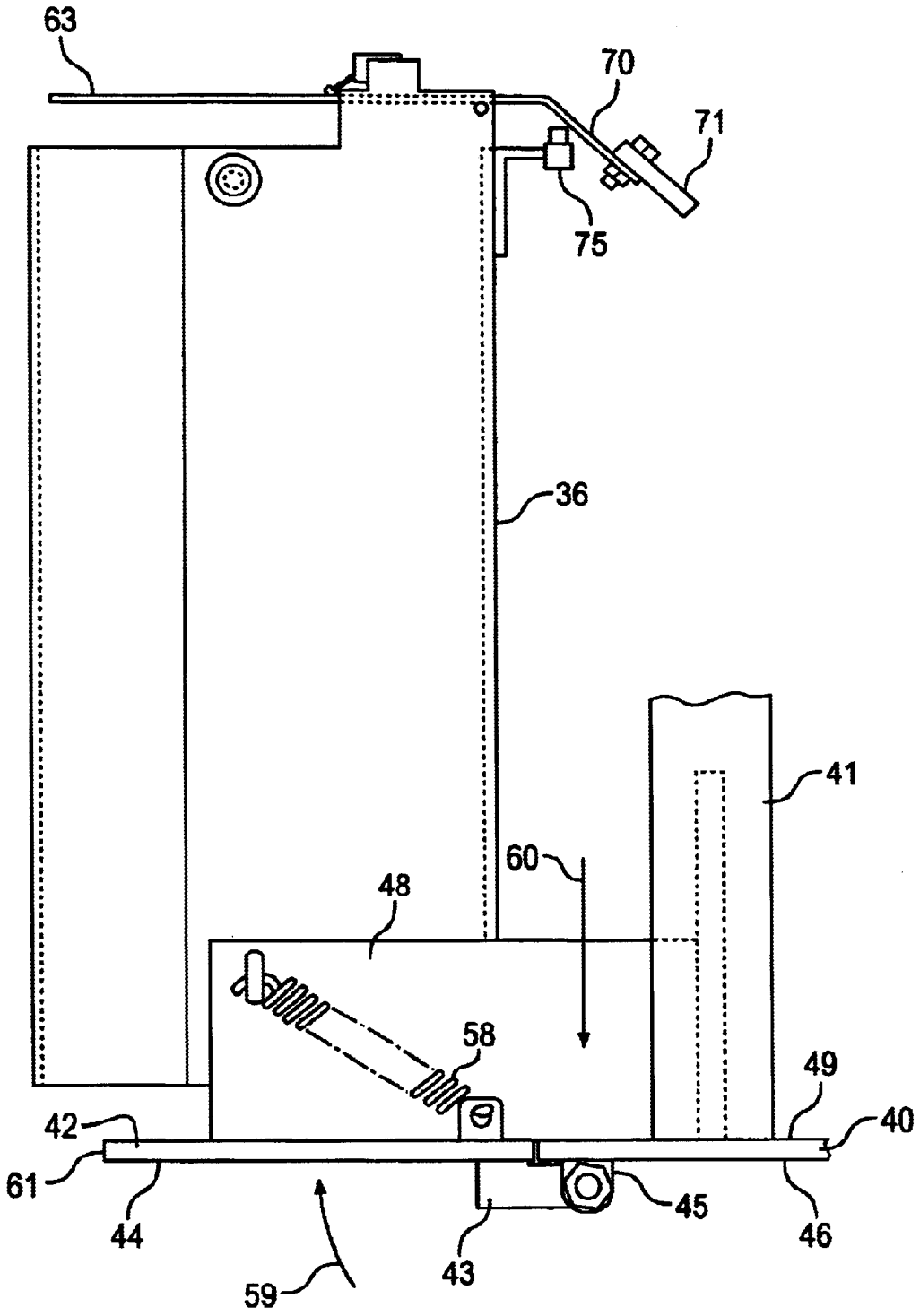
FIG. 4C is a side plan view of components of the embodiment of FIG. 1 with the platen disposed in the position ready for compaction of the trash contents.

As shown in FIGS. 1, 2, 3A, 3B, 4A, 4B, 4C and 5, the platen also defines a pivotable portion 42 that is pivotally connected to the first portion 40 of the platen. As shown in FIGS. 4A, 4B and 4C for example, one end of a hinge plate 43 can be connected to the underside 44 of the platen's pivotable portion 42. The opposite end of the hinge plate 43 can be rotatably connection to a flange 45 that depends from the underside 46 of the platen's first portion 40. Desirably, a separate hinge plate 43 and flange 45 arrangement can be disposed on opposite sides of the platen. As shown partially in phantom in FIG. 1 for example, the leading edge of the pivotable portion 42 and the first portion 40 of the platen are shaped to conform roughly to the shape of the sidewall 18 of the housing 13 and thus are circular for the embodiment shown.

The extendable member in the embodiment of the compacting mechanism shown in FIG. 2 also includes a pair of spaced apart reinforcing plates 48 for the platen. One of the longer narrow side edges 47 of each reinforcing plate 48 rests against the upper surface 49 of the first portion 40 of the platen. Each reinforcing plate 48 is rigidly connected to the first portion 40 of the platen and to one of the side bars 41, as by welding or riveting for example. Other connection means can include detachable rigid connections such as can be effected using bolts and nuts for example.

Figure 9:
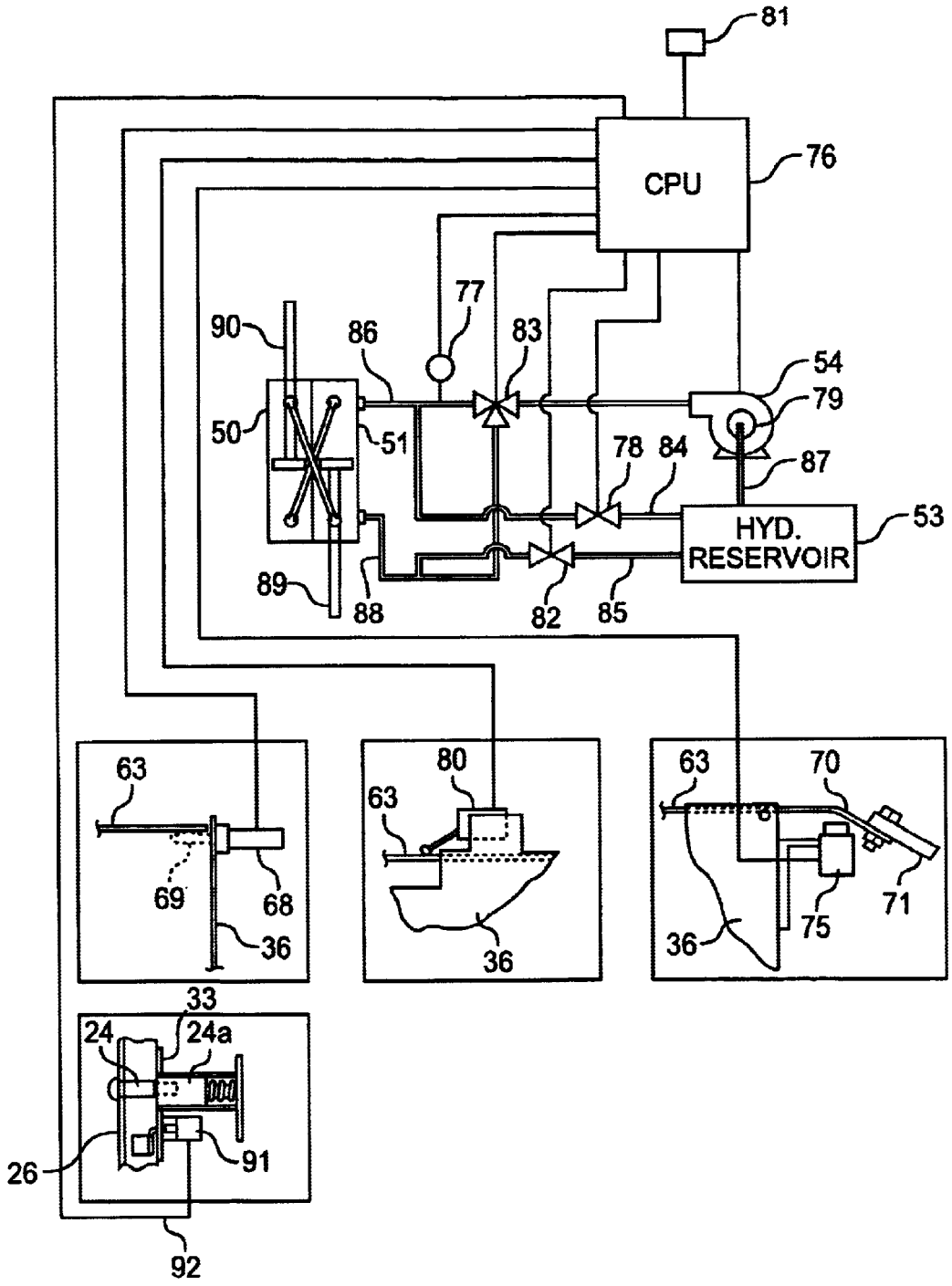
FIG. 9 is a schematic view of components of the embodiment of FIG. 1.

As shown in FIGS. 2 and 5 for example, the extendable member of the compacting mechanism also includes an interconnected pair of dual-acting hydraulic rams 50, 51. The hydraulic cylinder of each ram 50 or 51 is connected side-by-side to the hydraulic cylinder of the other ram 50 or 51. As shown in FIG. 2 for example, the piston of one ram 50 forms one end of the extendable member that is rigidly connected to the top rail 31 of the frame, and the piston of the second ram 51 is another and opposite end of the extendable member that is connected rigidly to the first portion 40 the platen. The piston connections desirably are generally centrally located between the side rails 30 of the frame. Each ram 50, 51 is a dual-acting ram such that an hydraulic pump 78 can operate the piston to be extended from the ram or retracted into the ram. As schematically shown in FIG. 9 for example, the rams 50, 51 are hydraulically connected to operate together. Thus, the chambers of the cylinders that cause the respective pistons to retract into the cylinders are hydraulically connected to each other. Similarly, the chambers of the cylinders that cause the respective pistons to extend out of the cylinders are hydraulically connected to each other. In this way, both pistons extend simultaneously or retract simultaneously. However, other hydraulic circuits could be used to power the compacting mechanism.

As shown in FIGS. 2 and 9 for example, the compacting mechanism further includes a reservoir 53 containing hydraulic fluid and an electric-motor-driven hydraulic pump 54 for introducing the hydraulic fluid under pressure into each ram 50, 51 to extend each piston accordingly. As shown schematically in FIG. 9, appropriate control valving also forms part of the compacting mechanism. As shown in FIGS. 3A and 3B for example, the rams 50, 51, reservoir 53, and pump 54 desirably are carried by the first portion 40 of the platen, but may be connected to the frame.

Moreover, while the hydraulic mechanism that powers the compacting mechanism is presently the preferred embodiment, other types of power can be used to provide the required compacting mechanism. For example, an electrically operated motor-driven compacting mechanism also could be used. Another alternative embodiment could employ air-driven cylinders rather than hydraulically actuated cylinders.

As shown in FIGS. 3A and 4A, the platen is configured to by-pass the trash by-pass chute 36 when the compacting mechanism is oriented in the fully retracted position. In this fully retracted position, the platen's pivotable portion 42 is folded away from the top 17 of the housing 13 and against the outside surface 55 of the rear wall of the by-pass chute 36. As shown in FIG. 3A for example, in this fully retracted orientation of the compacting mechanism, trash that enters the trash opening 20 through the top 17 of the housing falls through the funnel 23 and through the by-pass chute 36 and into the open top of the trash receptacle 27. As shown in FIG. 3B, the platen of the compacting mechanism is moving in the direction of the arrow designated 56 and is about to begin compacting a full load of trash 57 that is in the receptacle 27.

A mechanism is provided for biasing the pivotal portion 42 of the platen in an orientation that is generally coplanar with the first portion 40 of the paten. The coplanar orientation is easily visible in FIG. 4C. As the platen moves downwardly relative to the by-pass chute 36 in a manner illustrated successively in FIGS. 4A, 4B and 4C, the biasing mechanism eventually pulls the pivotable portion 42 of the platen into the coplanar orientation shown in FIG. 4C. As embodied herein and shown in FIGS. 4A, 4B and 4C, the biasing mechanism is provided in the form of a pair of resilient springs 58. One end of each spring 58 is connected to one end of the pivotable portion 42 of the platen. The opposite end of each spring 58 is connected to the reinforcing plate 48 that disposed at that same end of the pivotable portion 42.

As shown in FIG. 4C for example, as the platen's pivotable portion 42 finishes moving in the direction of the curved arrow designated 59, the platen's pivotable portion 42 rests against the long narrow edges 47 of the reinforcing plates. So positioned, the platen's pivotable portion 42 is disposed in an orientation that is generally co-planar with the first portion 40 of the platen. In this co-planar orientation of the pivotable portion 42 of the platen, the compacting mechanism can move in the direction of the straight arrow designated 60 to begin the portion of the compaction stroke during which compacting pressure is applied by the platen to the contents that are disposed in the lower portion 16 of the housing. As shown in FIG. 3B for example, the platen of the compacting mechanism is oriented for the portion of the compaction stroke during which pressure will begin to be applied to the trash contents disposed in the receptacle 27 located in the lower portion 16 of the housing 13.

The retraction stroke of the compacting mechanism is essentially a reverse of the compaction stroke of the compacting mechanism. Accordingly, the platen of the compacting mechanism moves in a direction that is opposite to the arrows designated 59 and 60 in FIG. 4B and FIG. 4C during the retraction stroke. In this way, the platen is repositioned away from the lower portion 16 of the housing 13 during at least the latter portion of the retraction stroke. During this latter portion of the retraction stroke shown in FIG. 4A for example, the pivotable portion 42 of the platen pivots away from the top 17 of the housing 13, and the free edge 61 of the pivotable portion 42 of the platen points down toward the lower portion 16 of the housing 13. In this way the compacting mechanism is configured for moving the platen through the retraction stroke so as to reposition the platen away from the lower portion 16 of the housing 13 during at least a portion of this retraction stroke.

In the illustrated embodiment, the springs 58 also provide a mechanism for biasing the pivotable portion 42 of the platen in an orientation that is capable of transmitting compacting pressure to the trash contents that are disposed in the lower portion 16 of the housing. This compacting pressure of course is only provided during a portion of the compaction stroke when the platen actually makes contact with the trash contents disposed in the lower portion 16 of the housing. In an embodiment that includes a receptacle 27 containing the trash contents 57 such as shown in FIG. 3B for example, the compacting pressure is applied to the trash contents disposed in the receptacle.

Figure 7:
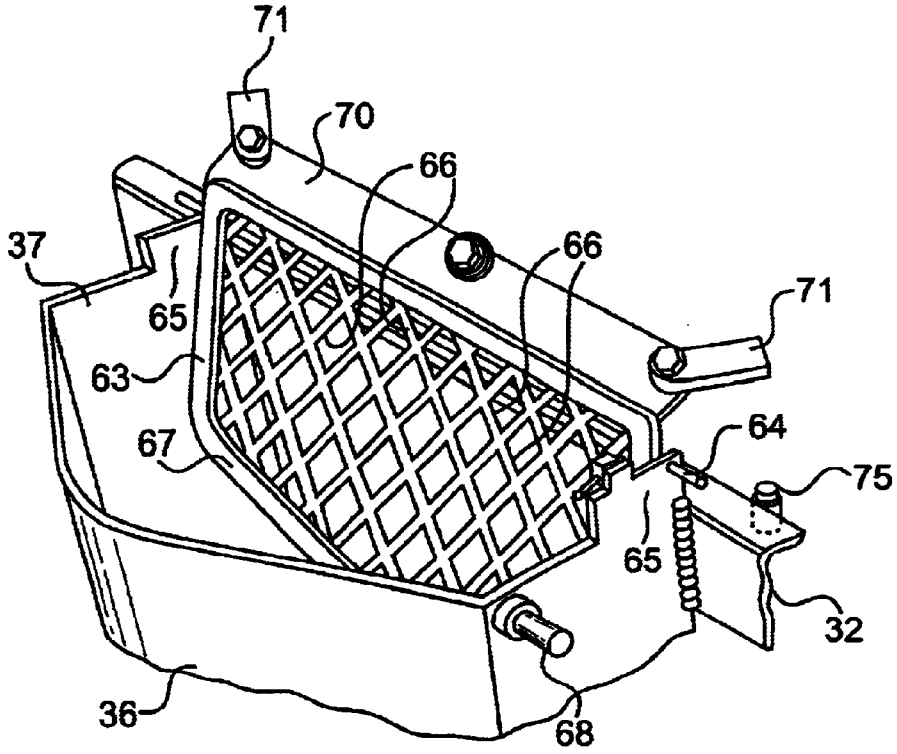
FIG. 7 shows an alternative embodiment of the hatch 63 taken from an elevated perspective view similar to that shown in FIG. 2.
Figure 8:
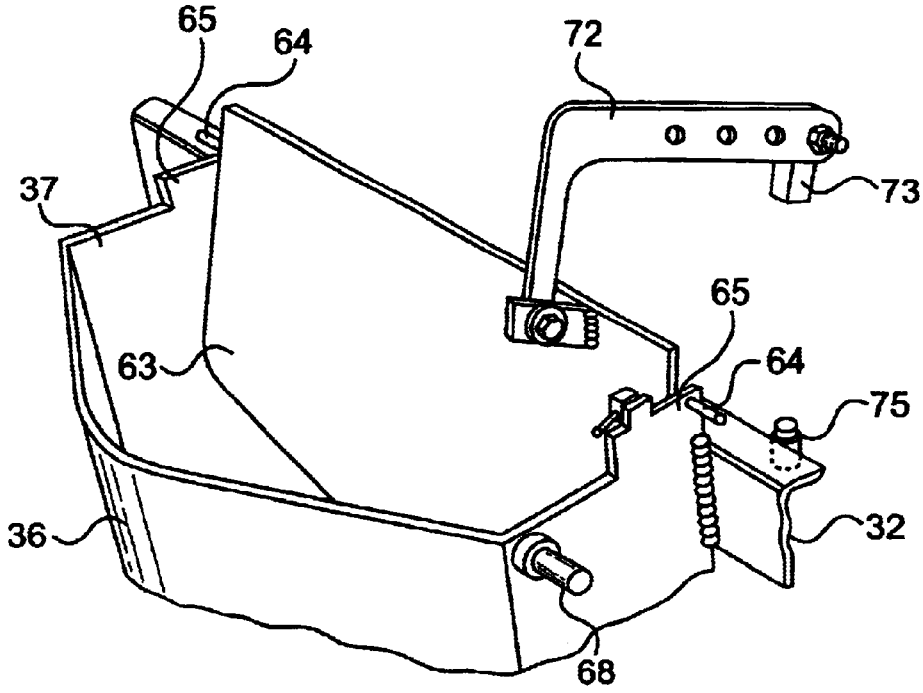
FIG. 8 shows an alternative embodiment of the counterweight taken from an elevated perspective view similar to that shown in FIG. 2.

In further accordance with the present invention, a hatch 63 is disposed at the entrance 37 of the trash by-pass chute 36. As embodied herein and shown in FIGS. 4A, 4B, 4C and 5 for example, the hatch 63 is configured to selectively pivot between at least a first orientation wherein the hatch 63 blocks the entrance of the trash by-pass chute 36 and at least a second orientation wherein the trash contents are permitted to enter and pass through the trash by-pass chute 36. As shown in FIGS. 2, 5, 7 and 8 for example, a rotatable bar 64 is connected to the hatch 63. The bar 64 does not rotate relative to the hatch 63, but is rotatably received in opposed trunnion flanges 65 that project above the entrance 37 at the upper edge of the by-pass chute 36 as shown in FIGS. 2, 7 and 8 for example.

As embodied herein and shown in FIGS. 3B and 4A for example, the hatch 63 is disposed in the first orientation in which the hatch 63 blocks the entrance 37 of the trash by-pass chute 36. This first orientation of the hatch 63 is also shown in chain-dashed line in FIG. 2 and in solid line in FIG. 1 for example. This first orientation of the hatch 63 envisions any one of several positions, including a position just above the entrance 37 or a position even with the entrance 37 as well as a position just below the entrance 37 and actually inside the trash by-pass chute 36. In a presently preferred embodiment shown in FIGS. 4B and 4C for example, the position of the hatch 63 is disposed just above the entrance 37 of the by-pass chute 36 when the hatch 63 is oriented so as to block the entrance of the trash by-pass chute 36.

The second orientation of the hatch 63 is illustrated in solid line in FIG. 2 and in dashed line in FIG. 3A for example. This second orientation of the hatch 63 also is illustrated in FIGS. 7 and 8 for example. In this second orientation, the hatch 63 is momentarily disposed near the inside surface of the rear wall of the by-pass chute 36 as the weight of the trash imparts angular momentum to the hatch 63 to rotate in that direction.

The hatch 63 can define a solid rigid member such as shown in FIGS. 1 and 8 for to example. Alternatively, the hatch 63 can define a plurality of openings 66 that allow fluids to pass through the openings and into the trash by-pass chute 36 as shown in FIG. 7 for example. Other configurations of the hatch 63 also are possible and include openings that are smaller than those shown in FIG. 7 and can be considered a finer mesh screening that is stretched between the peripheral border portion 67 that defines the outer periphery of the hatch 63. The hatch 63 is desirably disposed as shown in FIGS. 1, 3A and 3B between the entrance 37 of the trash by-pass chute 36 and the trash opening 20.

Figure 6:
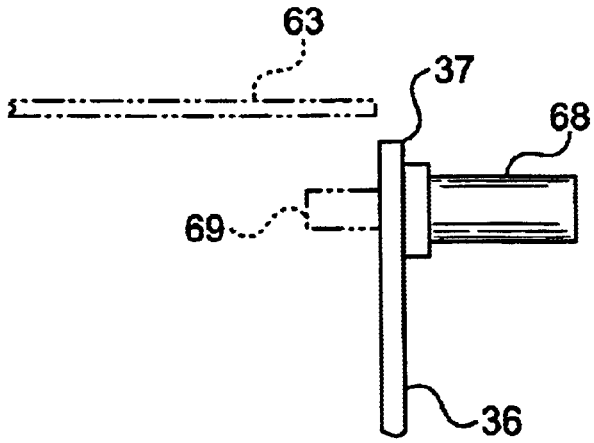
FIG. 6 is a front plan view of portions of components of the embodiment of FIG. 1 taken from the perspective of the direction in which arrows 6—6 are pointing in FIG. 2.

As shown in FIGS. 1, 2, 6, 7 and 8 for example, a hatch stop 68 is disposed at the entrance 37 of the trash by-pass chute 36. The hatch stop 68 is configured to selectively engage the hatch 63 so as to prevent the hatch 63 from attaining the second orientation wherein trash contents are permitted to enter through the entrance 37 of the trash by-pass chute 36. As shown in FIG. 6 for example, when the hatch stop 68 is actuated, a rigid member 69 (chain dashed line) extends into the interior space of the by-pass chute 36 near the entrance 37 thereof. So oriented, the hatch stop 68 prevents downward movement of the hatch 63, which is also indicated in a partial view by the chain-dashed line in FIG. 6. The hatch stop 68 also can be selectively configured to retract from within the interior space of the by-pass chute 36 in order to permit the hatch 63 to attain the second orientation shown in FIGS. 5, 7, 8 and 1 (solid line). An electrically actuatable solenoid provides a presently preferred embodiment of the hatch stop 68.

As shown in FIGS. 2, 5, and 7, a counterflange 70 is connected to the hatch 63, and at least one counterweight 71 is pivotally connected to the counterflange 70. Each counterweight 71 can be pivoted into a different position to change the moment of inertia of the combined counterflange 70 and counterweights 71 about the rotatable bar 64. In an alternative embodiment shown in FIG. 8 for example, the counterflange 70 is replaced by a bent arm 72 that carries at least one weight 73 that can be repositioned along the arm so as to vary the arm's moments of inertia about the rotatable bar 64. The arm 72 is desirably bent at a generally right angle.

The function of the counterflange 70 and the arm is to counterbalance the weight of the hatch 63. The desired equilibrium between the hatch 63 and the counterflange 70 and counterweight 71 holds the hatch 63 in the first orientation shown in FIGS. 4A, 4B and 4C for example. The hatch 63 remains in this equilibrium first orientation until the weight of trash resting on the hatch 63 tips the balance so that the hatch 63 pivots through the entrance of the by-pass chute 36 and towards the rear wall of the chute 36. With the hatch 63 so oriented as shown in FIGS. 3B, 7 and 8 for example, the trash can fall through the by-pass chute 36 and out of the exit 38 thereof and into the trash receptacle 27 in the lower portion 16 of the housing.

The compacting mechanism includes a control device that automatically operates the compacting mechanism to compact the trash that is thrown into the trash can 12 of the present invention. As embodied herein and shown schematically in FIG. 9 for example, the control mechanism desirably is provided in the form of a programmable controller 76 or computer, a pressure sensor 77, a hydraulic fluid pump 54, an electric motor 79 that powers the pump 54, a proximity sensor 75, a micro-switch 80, a reset switch 81, a sensor 91, a first solenoid valve 78, a second solenoid valve, a three port, two-way valve 83, and a solenoid operated cam 69.

A device can be provided to monitor when the hatch 63 is positioned above the hatch stop 68 member at the entrance of the by-pass chute 36 such as shown in FIGS. 4A, 4B and 4C for example. As shown in these FIGS., a proximity sensor 75 is desirably disposed at a location that enables the proximity sensor 75 to sense the presence or absence of the hatch 63. This position for deploying the sensor can be located according to the detection capabilities of the sensor 75. One such position can be on the frame as shown in FIGS. 2, 7 and 8 for example. Alternatively, this position for deploying the sensor can be located on the exterior surface of the by-pass chute 36 as shown in FIGS. 3A, 3B, 4A, 4B, 4C and 9 for example. When the proximity sensor 75 fails to sense the presence of the hatch 63, it means that the hatch 63 is disposed so that it is tilted into the by-pass chute 36 during a trash disposal event such as shown in FIGS. 3A, 7 and 8 for example. When the controller 76 senses a signal from the proximity sensor 75, this can indicate that the hatch 63 is positioned above the hatch stop 68 member at the entrance of the by-pass chute 36 as shown in FIGS. 3B and 4A for example.

A sensor is provided to signal each event constituting insertion of trash into the trash can 12 and through the by-pass chute 36. As embodied herein, a micro-switch 80 is disposed with the lever portion 74 in the vicinity of the entrance 37 to the by-pass chute 36 as shown in FIG. 4A for example. When the hatch 63 moves through the entrance 37 of the by-pass chute 36 and into the by-pass chute 36, the micro-switch 80 is triggered and generates a signal that is transmitted to the controller 76. When the hatch 63 moves out of the by-pass chute 36, the micro-switch is again triggered and generates another signal that is received by the controller 76. The controller can be programmed to initiate a compaction and retraction cycle for the compacting mechanism upon receiving signals from the micro-switch indicating a predetermined number of trash insertion events.

Another sensor is provided to detect whether the door 26 that governs access into the lower portion 16 of the housing 13 (and any trash receptacle 27 contained therein) is open or locked in the closed position. As embodied herein, an electronic switch 91 can be disposed within the portion of the frame 33 that butts against one edge 34 of the door 26 in the vicinity of the access opening 25 as shown in FIGS. 1 and 10 for example. The switch 91 is disposed so that when door 26 is closed and the locking mechanism is engaged, then switch 91 detects the presence of door 26 in the closed and locked position and transmits this condition to the controller 76 through electrical leads 92. Referring to FIG. 10 for example, switch 91 can include a spring-biased plunger 39 that may be disposed behind a slot 93 that is defined through the frame portion 33. When the door 26 closes and bolt 24 is threaded into the threaded opening of nut 24*a*, a tab 35 mounted to door 26 engages switch 91 by depressing plunger 39. In this way, locking the door 26 in the closed position changes the condition of switch 91. This change in the condition of switch 91 (from on to off or from off to on) is transmitted to the controller 76, which is preprogrammed to recognize that the door 36 is closed. Though in the embodiment shown, the switch 91 is mounted to the frame 33 of housing 13, there is no reason why the opposite arrangement (switch 91 to the door 36 and tab 35 mounted to frame 33) cannot be employed. When the door. 36 moves out of contact with frame 33, tab 35 disengages from plunger 39 and the condition of switch 91 is again changed, and this new condition is transmitted to and recognized by the controller 76. The controller 76 can be programmed desirably to prevent the initiation of a compaction and retraction cycle for the compacting mechanism upon recognizing that switch 91 is in a condition indicating that door 26 is not closed and locked.

FIG. 9 illustrates schematically one possible way for the control mechanism to automatically operate the compacting mechanism. The controller 76 is electrically connected to the electric motor 79 that powers the hydraulic fluid pump 54. The controller 76 is also electrically connected to the first and second solenoid valves 78, 82, that are disposed respectively in the hydraulic lines 84, 85 leading from the hydraulic reservoir 53 to the hydraulic rams 50, 51. The controller 76 is also electrically connected to the 3-port, two-way valve 83 that governs whether the hydraulic rams 50, 51 are in the retraction mode or the extension mode. The controller 76 is connected to the pressure sensor 77 that is disposed in the hydraulic line 86 that is used to provide hydraulic fluid to the cylinder chambers of the rams 50, 51 that effect the compaction stroke of the compacting mechanism. The controller 76 also is connected to operate the hatch stop 68 to move the cam 69 into or out of the interior of the by-pass chute 36. Additionally, the controller 76 is connected to receive monitoring signals from each of the micro-switch 80 and the proximity sensor 75.

When the controller 76 has received a predetermined number of signals generated by the micro-switch 80, corresponding to the predetermined number of trash disposals passing through the by-pass chute 36, the controller 76 checks for a signal from the proximity sensor 75, which is disposed at a location that enables the proximity sensor 75 to sense the presence or absence of the hatch 63. When the proximity sensor 75 senses the absence of the hatch 63, it means that the hatch 63 is disposed so that it is tilted into the by-pass chute 36 during a trash disposal event such as shown in FIG. 3A. It is undesirable for a compaction stroke to be initiated under this circumstance because it would be possible for a user to place one's hand through the by-pass chute 36. Thus, the controller is desirably programmed so that only when the controller 76 senses a signal from the proximity sensor 75 indicating the presence of the hatch 63, indicating that the hatch 63 is positioned above the hatch stop 68 at the entrance of the by-pass chute 36, will the controller activate the hatch stop 68 to insert the cam 69 into the by-pass chute 36 as shown in chain dashed line in FIGS. 6 and 9 for example. In this way, the hatch effectively closes the by-pass chute before the controller 76 initiates the compaction stroke.

Upon sensing the signal from the proximity sensor 75 in indicating the position of the hatch as in FIG. 4A for example, the controller 76 is programmed to send a signal to activate the hatch stop 68 to protrude into the interior of the by-pass chute 36 and prevent the hatch 63 from moving through the entrance of the by-pass chute 36 and into the by-pass chute 36. As noted above, this is a safety measure that prevents the user from placing one's hand into the by-pass chute 36 during the compacting cycle. This also has the effect of preventing further trash from passing through the by-pass chute 36 while the compacting cycle is being performed by the compacting mechanism. The controller 76 also checks the condition of switch 91 that senses whether the door 26 is open or closed and locked. The compaction sequence will not be initiated unless controller 76 detects that the door 26 is closed and locked.

The controller 76 is programmed to then send a signal to the valves 78, 82, 83 controlling the flow of hydraulic fluid into the appropriate chambers of the hydraulic rams 50, 51. The signals of the controller 76 configure the valves so that when the electric motor operates the pump 54, the hydraulic fluid flows into the chambers of the dual acting cylinders that result in the extension of the pistons away from the cylinders to produce the compaction stroke of the compacting mechanism. Valve 83 is configured so that hydraulic line 88 is closed to the pump 54 and hydraulic line 86 is open to the pump 54. Valve 82 is opened so that hydraulic line 88 is open to the reservoir 53. Valve 78 is closed so that hydraulic line 86 is closed to the reservoir 53. Once the valves are appropriately configured, the controller provides power to the motor 79 and the pump 54 begins to provide hydraulic fluid out of the reservoir 53 via hydraulic line 87 and into the rams 50, 51 via hydraulic line 86. The pistons in the rams 50, 51 begin to extend the rams to produce the compaction stroke of the compacting mechanism as in FIG. 3B for example.

A pressure sensor 77 is disposed in the hydraulic circuit and generates a signal to the controller 76 upon detecting a predetermined level of pressure. Typically, the compacting pressure that is detected is on the order of 1800 psi. When the platen meets sufficient resistance such that the predetermined pressure is being applied by the platen to the trash beneath the platen, this is the maximum desired compacting pressure.

Upon sensing this predetermined level of compacting pressure, the controller 76 signals the hydraulic valves to switch the provision of hydraulic fluid to the chambers that result in retraction of the pistons into the dual acting hydraulic cylinders. In the embodiment illustrated in FIG. 9 for example, Valve 83 is configured so that hydraulic line 88 is open to the pump 54 and hydraulic line 86 is closed to the pump 54. Valve 82 is closed so that hydraulic line 88 is closed to the reservoir 53. Valve 78 is opened so that hydraulic line 86 is opened to the reservoir 53. This valve reconfiguration activates the retraction stroke of the compacting mechanism. The platen then moves,away from the lower portion 16 of the housing and toward the upper portion 14 of the housing as shown in FIGS. 3A and 5 for example. Thus, a single compacting cycle has been performed.

A typical operation cycle of a presently preferred embodiment of the trash can of the invention now will be described. As shown in FIG. 3A, trash is tossed onto the top wall 19 of the housing 13 or into the trash opening 20 defined through the top 17 of the housing 13. The trash moves under the force of gravity down the incline of the top wall 19 toward the trash opening 20 and eventually through the trash opening 20 and into the funnel 23 connected to the trash opening 20.

The trash next encounters the hatch 63, which is counterbalanced and pivots into the by-pass chute 36 to allow the trash to enter the by-pass chute 36 through the entrance 37 thereof. The trash passes through the by-pass chute 36 and flows out of the exit 38 at the opposite end of the by-pass chute 36 and into the lower portion 16 of the housing 13. In those embodiments wherein a trash receptacle 27 is disposed in the lower portion 16 of the housing, the trash falls into and is collected in the trash receptacle 27.

Each time the hatch 63 tilts into the by-pass chute 36 to permit trash to pass through, a micro-switch 80 generates a signal that is transmitted to the controller 76. Each such signal corresponds to a trash insertion event in which trash is admitted into the trash can and falls down to the hatch 63 and drops through the by-pass chute 36. The controller 76 is programmed to activate the compacting mechanism upon receiving a predetermined number of signals from the micro-switch 80.

Before activating the compacting mechanism, the controller 76 checks the state of the proximity sensor 75 that detects the position of the hatch 63 to be sure that the hatch 63 is held in the closed position such as shown in FIG. 4A for example. If the proximity sensor 75 indicates that the hatch 63 is in the closed position, the controller 76 activates the hatch stop 68 to deploy the cam 69 into the trash by-pass chute 36 as shown in chain-dashed line in FIG. 6 for example. Thus, the hatch 63 is prevented from admitting additional trash into the by-pass chute and receptacle 27 and also prevents a user from placing one's hand into the by-pass chute 36.

The controller 76 then checks the condition of sensor 91 to determine that the door 26 is closed and locked. Assuming that the door 26 is closed and locked, then controller 76 activates the compacting mechanism to initiate the compaction stroke, which is partially illustrated successively in FIGS. 4A, 4B, 4C and 3B for example. To operate the compacting mechanism to begin the compaction stroke, the controller 76 closes first solenoid valve 78 and opens second solenoid valve 82. The controller 76 also orients the 3-way valve so that hydraulic fluid exiting the pump 54 passes through the hydraulic line 86 in which the pressure sensor 77 is disposed and into the interconnected chambers of the dual action hydraulic rams 50, 51 that will operate the pistons 90, 89 so as to extend the pistons from the hydraulic cylinders. The controller 76 then will activate the pump 54 that withdraws hydraulic fluid from the reservoir 53 via hydraulic line 87 and pumps the hydraulic fluid through the open hydraulic line 86 of the appropriate chamber of the dual-action rams. As schematically shown in FIG. 9, the suction chamber of each ram empties into the opposite hydraulic line 88 and returns the hydraulic fluid to the hydraulic reservoir 53. Eventually, the platen is moved into a position shown for example in FIG. 3B wherein the platen begins to apply the compacting pressure to the contents of the trash receptacle 27.

The compacting mechanism moves through the compaction stroke until the platen is opposed by a predetermined compacting force, which indicates that the trash has been compressed to the desired extent. Whereupon the controller 76 receives the predetermined signal from the pressure sensor 77 and initiates the retraction stroke of the compacting mechanism. When the controller 76 operates the compacting mechanism to perform the retraction stroke, the second solenoid valve 82 is closed and the first solenoid valve 78 is opened. The 3-way valve is reconfigured so that the hydraulic fluid leaving the pump 54 will be directed to the opposite chambers of the dual-action hydraulic rams.

During the retraction stroke, the compacting mechanism retraces the steps successively shown in FIGS. 3B, 4C, 4B and 4A and eventually attains the fully retracted orientation shown in FIGS. 3A and 5 for example. Whereupon the controller 76 releases the hatch stop 68 and retracts the cam 69 out of the by-pass chute 36 so as to thereafter permit the hatch 63 to be pivoted past entrance 37 and into the by-pass chute 36 to allow passage of trash through the by-pass chute 36 and into the lower portion 16 of the housing. Eventually, the attendant will open the door 26 in the side of the lower portion 16 of the housing 13 and withdraw the compacted trash in the trash receptacle 27 from the trash can 12 and transport the compacted trash to a central collection site for further disposal of the trash.

The controller 76 is desirably programmed so that upon monitoring a predetermined number of compaction strokes and retraction strokes comprising a single compacting cycle, the controller 76 will assume that the trash receptacle 27 is full and should not receive additional trash. This predetermined number of cycles is intended to approximate when the desired amount of trash will have become compacted in the lower portion 16 of the housing such that the attendant should empty the trash can. When controller 76 records this predetermined number of compacting cycles, the controller 76 is desirably programmed to check the proximity sensor 75 to ensure that the hatch 63 is oriented in the closed position shown in FIG. 4A for example. Upon detecting that the hatch 63 is closed, the controller 76 is programmed to send a signal to the hatch stop 68 to extend the cam 69 into the by-pass chute 36 and prevent the hatch 63 from moving into the by-pass chute 36. This closes the by-pass chute 36 and prevents passage of further trash from the trash opening 20 into the by-pass chute 36. With the by-pass chute 36 closed, if further refuse is tossed into the trash opening 20, it quickly will accumulate in the funnel 23. Eventually, the entire length of the funnel 23 is full, and the trash begins to protrude out of the trash opening 20. This is a sign to the attendant that the trash can 12 should be emptied.

After the attendant empties the compacted trash from the trash can 12, the attendant must press the reset button 81. This sends a signal to the controller 76 to withdraw the hatch stop 68 from protruding into the trash by-pass chute 36, thereby reopening the by-pass chute 36. Trash once again is permitted to pass through the by-pass chute 36. The controller is programmed to begin monitoring again for another predetermined number of compacting cycles.

What is claimed is:

1. An apparatus for receiving a variety of different types of consumer trash in high traffic public areas and compacting the received trash together into a compacted mass, comprising:

a housing, said housing including a top and a side wall connected to said top, said housing having an upper portion, a lower portion disposed beneath said upper portion, and an intermediate portion disposed between said upper portion and said lower portion;

a trash opening defined through said top;

a frame disposed within said housing;

a trash by-pass chute disposed within said housing and having an entrance aligned generally with said trash opening, said by-pass chute having an exit disposed to empty into said lower portion of said housing;

a compacting mechanism carried by said frame and including a platen, said compacting mechanism being configured for moving said platen through a compaction stroke to apply compacting pressure to trash contents located in said lower portion of said housing during at least a portion of said compaction stroke; and wherein said platen extends sufficiently across said lower portion of said housing to cover substantially all of the trash that can be contained therein during at least a portion of said compaction stroke.

2. An apparatus as in claim 1, wherein said compacting mechanism being configured for moving platen through a retraction stroke to reposition said platen away from said lower portion of said housing during at least a portion of said retraction stroke and said platen is configured to by-pass said trash by-pass chute at least a portion of said retraction stroke.

3. An apparatus as in claim 1, wherein said compacting mechanism includes a controller configured to activate said compacting mechanism, said controller being disposed within said hosing.

4. An apparatus as in claim 3, further comprising a detector carried by said frame and configured and disposed to detect when trash enters said trash by-pass chute and to generate a signal indicating such detection and transmit said signal to said controller.

5. An apparatus as in claim 3, further comprising:

an hydraulic cylinder carried by said frame and forming part of said compacting mechanism; and a pressure sensor connected to said hydraulic cylinder and configured to generate a pressure detection signal upon detection of a predetermined amount of pressure, said pressure sensor being further connected to said controller and configured to provide said pressure detection signal to said controller.

6. An apparatus as in claim 1, further comprising:

a trash receptacle disposed in said lower portion of said housing and defining a receptacle opening disposed to receive trash contents passing out of said exit of said by-pass chute.

7. An apparatus as in claim 6, further comprising:

an access opening defined through said lower portion of said housing and configured to permit selective insertion of said receptacle into said lower portion of said housing and withdrawal of said receptacle from said lower portion of said housing; and a door defining a section of said lower portion of said housing and configured to selectively open and close said access opening.

8. An apparatus as in claim 4 wherein said controller being configured to activate said compacting mechanism after receiving from said detector signals that indicate that trash has been received through said trash by-pass chute a predetermined number of times.

9. An apparatus as in claim 1, further comprising:

a controller disposed within said housing;

an access opening defined through said lower portion of said housing;

a door defining a section of said lower portion of said housing and configured to selectively open and close said access opening; and a sensor connected to said controller and disposed to detect at least when said door is disposed to close said access opening.

10. An apparatus as in claim 1, wherein said top is configured so that trash moving along said top under the influence of the force of gravity tends to move toward said trash opening.

11. An apparatus as in claim 10, wherein said top is disposed at a predetermined acute angle relative to a horizontal plane and said top is tilted toward said trash opening.

12. An apparatus as in claim 1, further comprising:

a funnel defining an axially extending hollow channel connected to said top and extending into said housing, said hollow channel of said funnel having a first end disposed in alignment with said trash opening and a second end disposed opposite said first end and closer to said lower portion of said housing than said first end.

13. An apparatus as in claim 1, wherein said compacting mechanism includes an extendable member having a pair of opposed ends, said platen defining a first portion connected to one of said ends of said extendable member, said platen defining a pivotable portion pivotally connected to said first portion of said platen.

14. An apparatus as in claim 13, further comprising:

a mechanism for biasing said pivotable portion of said platen in an orientation that is generally coplanar with said first portion.

15. An apparatus as in claim 13, further comprising:

a mechanism for biasing said pivotable portion in an orientation that is capable of transmitting compacting pressure to trash contents disposed in said lower portion of said housing during at least a portion of said compaction stroke.

16. An apparatus as in claim 15, wherein said mechanism for biasing said pivotable portion includes at least one spring connected to said pivotable portion of said platen.

17. An apparatus for containing and compacting trash contents, comprising:

a housing, said housing including a top and a side wall connected to said top, said housing having an upper portion, a lower portion disposed beneath said upper portion, and an intermediate portion disposed between said upper portion and said lower portion;

a trash opening defined through said top;

a frame disposed within said housing;

a trash by-pass chute disposed within said housing and having an entrance aligned generally with said trash opening, said by-pass chute having an exit disposed to empty into said lower portion of said housing;

a compacting mechanism carried by said frame and including a platen, said compacting mechanism being configured for moving said platen through a compaction stroke to apply compacting pressure to trash contents located in said lower portion of said housing during at least a portion of said compaction stroke;

wherein said compacting mechanism includes an extendable member having a pair of opposed ends, said platen defining a first portion connected to one of said ends of said extendable member, said platen defining a pivotable portion pivotally connected to said first portion of said platen; and wherein said compacting mechanism is configured for moving said platen through a retraction stroke to reposition said platen away from said lower portion of said housing during at least a portion of said retraction stroke and said compacting mechanism is further configured so that said pivotable portion of said platen pivots away from said top of said housing during at least a portion of said retraction stroke.

18. An apparatus as in claim 17, further comprising:

a hatch disposed between said entrance of said trash by-pass chute and said trash opening, said hatch being configured to selectively pivot between a first orientation blocking said entrance of said trash by-pass chute to prevent trash from entering said trash by-pass chute and a second orientation wherein trash contents are permitted to enter said trash by-pass chute.

19. An apparatus as in claim 17, further comprising:

a hatch disposed at said entrance of said trash by-pass chute, said hatch being configured to selectively pivot between at least a first orientation blocking said entrance of said trash by-pass chute to prevent trash from entering said trash by-pass chute and at least a second orientation wherein trash contents are permitted to enter said trash by-pass chute.

20. An apparatus as in claim 19, wherein said hatch defines a plurality of openings that allow fluids to pass through said openings and into said trash by-pass chute.

21. An apparatus as in claim 19, further comprising:

a rotatable bar connected to said hatch, a counter flange connected to said hatch, and at least one counter weight pivotably connected to said counter flange.

22. An apparatus as in claim 19, further comprising:

a rotatable bar connected to said hatch, an arm connected to said hatch, and at least one counter weight detachably connected to said arm.

23. An apparatus as in claim 19, further comprising:

a controller disposed within said housing; and a sensor disposed within said housing and configured for detecting movement of said hatch with respect to said entrance of said by-pass chute, said sensor being connected to said controller and configured to generate a signal that is transmitted to said controller upon detection of said movement of said hatch.

24. An apparatus for receiving a variety of different types of consumer trash in high traffic public areas and compacting the received trash together into a compacted mass, further comprising:

a housing, said housing including a top and a side wall connected to said top, said housing having an upper portion, a lower portion disposed beneath said upper portion, and an intermediate portion disposed between said upper portion and said lower portion;

a trash opening defined through said top;

frame disposed within said housing;

a trash by-pass chute disposed within said housing and having an entrance aligned generally with said trash opening, said by-pass chute having an exit disposed to empty into said lower portion of said housing;

a compacting mechanism carried by said frame and including a platen, said compacting mechanism being configured for moving said platen through a compaction stroke to apply compacting pressure to trash contents located in said lower portion of said housing during at least a portion of said compaction stroke;

a hatch disposed at said entrance of said trash by-pass chute, said hatch being configured to selectively pivot between at least a first orientation blocking said entrance of said trash by-pass chute to prevent trash from entering said trash by-pass chute and at least a second orientation wherein trash contents are permitted to enter said trash by-pass chute; and a hatch stop disposed at said entrance of said trash by-pass chute, said hatch stop being configured to selectively engage said hatch to prevent said hatch from attaining said second orientation wherein trash contents are permitted to enter said trash by-pass chute.

25. An apparatus as in claim 24, wherein:

said hatch stop being configured to selectively engage said hatch to permit said hatch to attain said second orientation wherein trash contents are permitted to enter said trash by-pass chute.

* * * * *

UNITED STATES PATENT AND TRADEMARK OFFICE

CERTIFICATE OF CORRECTION

PATENT NO. : 6,701,832 B1
DATED : March 9, 2004
INVENTOR(S) : Bobby L. Hawkins

It is certified that error appears in the above-identified patent and that said Letters Patent is hereby corrected as shown below:

Column 16,
Line 6, insert the word "said" between the words "moving" and "platen"
Line 10, insert the word "during" between the words "chute" and "at"

Column 18,
Line 38, insert the word -- a -- at the beginning of line.

Signed and Sealed this

Twelfth Day of October, 2004

JON W. DUDAS
*Director of the United States Patent and Trademark Office*